US007765713B2

(12) United States Patent
Ehrhard et al.

(10) Patent No.: US 7,765,713 B2
(45) Date of Patent: Aug. 3, 2010

(54) WATER VAPOR MONITORING APPARATUS

(75) Inventors: Marco Ehrhard, Muenstertal (DE); Carmen Lema Martinez, Bern (CH); Joerg Luemkemann, Loerrach (DE); Bernd Schirmer, March (DE); Alexander Streubel, Mannheim (DE); Lars Sukowski, Basel (CH)

(73) Assignee: Hoffmann-La Roche Inc., Nutley, NJ (US)

( * ) Notice: Subject to any disclaimer, the term of this patent is extended or adjusted under 35 U.S.C. 154(b) by 505 days.

(21) Appl. No.: 11/732,975

(22) Filed: Apr. 5, 2007

(65) Prior Publication Data

US 2008/0011078 A1 Jan. 17, 2008

(30) Foreign Application Priority Data

Apr. 10, 2006 (EP) ..... 06112445

(51) Int. Cl.
*F26B 19/00* (2006.01)

(52) U.S. Cl. ..... 34/89; 34/73; 34/284

(58) Field of Classification Search ..... 34/284, 34/287, 292, 72, 73, 89, 559; 374/20; 250/339.02, 250/339.07, 339.12
See application file for complete search history.

(56) References Cited

U.S. PATENT DOCUMENTS

| | | | | |
|---|---|---|---|---|
| 3,020,645 | A | 2/1962 | Copson | |
| 3,812,596 | A | 5/1974 | Wilmanns | |
| 4,847,512 | A | 7/1989 | Seta | |
| 4,862,001 | A | 8/1989 | Dowling et al. | |
| 5,022,265 | A | 6/1991 | Voss | |
| 5,804,702 | A | 9/1998 | Hovde et al. | |
| 6,657,197 | B2 * | 12/2003 | Droessler et al. | 250/339.12 |
| 6,848,196 | B2 | 2/2005 | Brülls | |
| 2003/0116027 | A1 | 6/2003 | Brulls | |
| 2006/0137212 | A1 | 6/2006 | Nomine | |

FOREIGN PATENT DOCUMENTS

| | | | |
|---|---|---|---|
| DE | 44 41 350 | C1 | 6/1996 |
| FR | 2 719 656 | A1 | 11/1995 |

OTHER PUBLICATIONS

Bardat et al., Moisture Measurement: A New Method for Monitoring Freeze-drying Cycles, Journal of Parenteral Science and Techno., 1993, pp. 293-299, 47.

Genin et al., A method for on-line determination of residual water content and sublimation end-point during freeze-drying, Chemical Engineering and Processing, 1996, pp. 255-263, 35.

Herriott et al., Folded Optical Delay Lines, Applied Optics, Aug. 1965, pp. 883-889, Vo. 4, No. 8.

Herriott et al., Off-Axis Paths in Spherical Mirror Interferometers, Applied Optics, Apr. 1964, pp. 523-526, vol. 3, No. 4.

(Continued)

*Primary Examiner*—Jiping Lu
(74) *Attorney, Agent, or Firm*—George W. Johnston; Dennis P. Tramaloni

(57) ABSTRACT

A freeze-drying device for the monitoring and control of water vapor in a freeze-drying process, comprising an optical spectrometer, and methods of using same to monitor and control the amount of water vapor in said process under sterile conditions.

5 Claims, 10 Drawing Sheets

OTHER PUBLICATIONS

McManus et al., Astigmatic mirror multipass absorption cells for long-path-length spectroscopy, Applied Optics, Jun. 20, 1995, pp. 3336-3348, vol. 34, No. 18.

Schirmer et al., A new method for the determination of membrane permeability by spatially resolved concentration measurements, Measurement Science and Technology, 2004, pp. 195-202, vol. 15.

Schirmer et al., Experimental investigation of the water vapour concentration near phase boundaries with evaporation, Measurement Science and Technology, 2004, pp. 1671-1682, 15.

Schirmer et al., High precision trace humidity measurements with a fibre-coupled diode laser absorption spectrometer at atmospheric pressure, Measurement Science and Technology, 2000, pp. 382-391, vol. 11.

White, John U., Long Optical Paths of Large Aperture, Journal of the Optical Society of America, 1942, pp. 285-288, 32.

White, John U., Very long optical paths in air, Journal of the Optical Society of America, May 1976, pp. 411-416, vol. 66, No. 5.

* cited by examiner

WATER VAPOR MONITORING APPARATUS

FIELD OF THE INVENTION

The invention relates to an apparatus for monitoring the water vapor in a freeze-drying process of, for example, pharmaceutical products. The invention also relates to a method for using the apparatus and to uses of said apparatus.

BACKGROUND OF THE INVENTION

Freeze-drying is a method of gentle desiccation of delicate products, e.g. pharmaceuticals, which cannot tolerate drying at elevated temperatures. The product to be dried is aliquoted into containers (e.g. partially glass vials sealed with a stopper), which are placed on a cooled, temperature controlled shelf within the freeze dryer. The shelf temperature is reduced and the product is cooled to a uniform, defined temperature. After complete freezing, the pressure in the dryer is lowered to a defined pressure to initiate primary drying. During the primary drying, water vapor is progressively removed from the frozen mass by sublimation whilst the shelf temperature and chamber vacuum are controlled at an exactly defined level. Secondary drying is initiated by increasing the shelf temperature and reducing the chamber pressure further so that water adsorbed to the product structure can be removed until the residual water content decreases to the desired level. The containers can be sealed in situ, under a protective atmosphere if required.

While freeze-drying is a known technique per se, it still represents a challenge because even when implemented by a skilled staff great care is necessary to control the process without damaging the product to be freeze-dried.

Another major issue is that a defined residual moisture must be reached in the final product before stopping the freeze-drying process. If the residual moisture is too high it may affect the stability of the active ingredient and thus the pharmaceutical grade of the product. It must hence be ascertained that the residual moisture has reached the defined level before stopping the freeze-drying process.

However, precisely determining at which point the freeze-drying process must be stopped would mean measuring the residual moisture in each vial during the freeze-drying process before taking the decision of stopping the freeze-drying. This is almost impossible to do in practice with a large number of vials as it is generally the case in the pharmaceutical field, since it would require stopping the freeze-drying process several times and taking the vials out of the freeze-drying device for measuring the residual moisture in each vial. This would be on the one hand very time consuming and on the other hand it would adversely affect the freeze-drying process, especially when the freeze-drying process must be conducted in sterile conditions.

Currently, the solution adopted by the pharmaceutical industry is to include a safety period by prolonging the period of freeze-drying past the empirically determined drying time in order to ascertain that the residual moisture is under a defined level.

There is hence a need for an apparatus for monitoring the residual moisture in the products subjected to a freeze-drying process for, inter alia, determining the end of the freeze-drying process and save the costs and inconvenience associated with the safety period.

The prior art already described means to monitor or control a freeze-drying process by monitoring one or several physical parameters as described hereinafter.

One of these parameters is the product temperature. The product temperature changes during the primary drying process and converges towards the shelf temperature. At the end of the sublimation phase (primary drying), little water (or solvent) is left and consequently the amount of chill by evaporation is reduced. By monitoring the product temperature with sensors, the end of the sublimation phase can be roughly estimated and correlated to the residual moisture in the products. However, the temperature probes influence the freeze-drying process. This can result in an early change to the secondary drying (desorption phase) which can destroy the structure of the dried product (Meltback). As this test is destructive, only a few samples out of a large population (product) can be tested and one cannot ascertain that the whole population of samples (product) is sufficiently dry.

Another parameter is the pressure. On availability of a pirani-type and a capacitance-type vacuum gauge, a comparative pressure measurement can give hints towards the composition of the process gas in the chamber. In this case the dependence of the pirani-signal on the composition of the gas (in particular on the water vapor content) and the independence of the capacitance signal (representing the absolute pressure) upon the water vapor content results in an "apparent" pressure difference. This difference is reduced with the progression of the drying process and subsequently of the changing gas composition inside the chamber. However, this measurement is not accurate and can only give a hint towards the status of the drying process.

Another way of using the measurement of pressure is the pressure rise test. During the pressure rise test, the freeze-drying chamber is completely sealed against mass transfer. The pressure difference is recorded over a defined period of time (usually several minutes). The time dependent pressure difference is correlated towards a certain drying status of the material inside the chamber. This test is mainly applied at the end of the secondary drying, to confirm, that the drying status of the material inside the chamber is within the specified level. Nevertheless, if a large number of items is dried, the contribution of a single item to the total pressure rise result is very small. For that reason, the test can not identify single items or small groups of items that are not dried properly.

Still another parameter is the water vapor partial pressure inside the process gas of a freeze-drying chamber. In this case an aluminum oxide dew point sensor can be used. The $Al_2O_3$ capacitive dew point sensor can measure directly the water vapor partial pressure inside the process gas of a freeze-drying chamber. This technique is very sensitive (e.g. −90° C. dewpoint) and can monitor the changes of the process gas during the whole process. This can help to identify the end of the primary drying phase. Furthermore, the measured value at the end of the secondary drying can also be correlated to a certain drying state of the product. The dew point sensors however suffer a major drawback since they can not tolerate sterilizing conditions (e.g. water steam, 121° C. 15 min), which are a requirement for drying e.g. pharmaceuticals.

Yet another parameter is the measure of the weight of the product. In this case, balances are applied in some areas to detect weight loss of the material to be dried. In the case of pharmaceutical applications, the vials are weighed over time to determine weight loss due to the evaporating water. This method is not applicable during commercial production of clinical material, as the balances are not sterilizable. Furthermore, it is known that items directly adjacent to the balance do not dry representatively. This fact can lead to misjudgments concerning the drying state of the other items in one batch. A further disadvantage is that only a few samples out of a large population (product) can be tested.

The measurement of the water vapor has been described by Winter et. al. and U.S. Pat. No. 6,848,196 B2 as a measurable parameter for monitoring the freeze-drying process. This method involves the use of a near infrared spectrometer (NIR: Near Infrared) coupled to a light fiber to measure the residual water content of a lyophilized pharmaceutical product in situ during the process. However, the NIR-irradiation can only penetrate a few millimeters into the dried material. Therefore a representative measurement of the entire vial is not possible. It is known that any material being adjacent to a vial can influence the drying behavior of the content of the container. Thus, the vial will not dry representatively. A further disadvantage is that only a few samples out of a large population (product) can be tested and hence a global monitoring, of the entire population cannot be achieved.

This short review of the prior art shows that the means currently available for the monitoring of a freeze-drying process are not completely satisfying and still presents many disadvantages.

The objective of the invention is to overcome the inconvenience associated with the prior art and to provide an apparatus and a method which allow the monitoring of a freeze-drying process in accordance with the requirements of the pharmaceutical field.

SUMMARY OF THE INVENTION

As described hereinabove, in one aspect, the invention relates to an apparatus for the monitoring and the control of water vapor in a freeze-drying process comprising a sterilizable freeze-drying device and an optical spectrometer isolated from the sterilizable freeze-drying device, said optical spectrometer measuring the water vapor present in the atmosphere of the freeze-drying device without adversely affecting the sterilizability of the freeze-drying device.

Because it uses an optical spectrometer which is isolated from the freeze-drying device, the apparatus of the invention can be operated in a fully sterilizable environment.

Further, the process of the invention is much more accurate and easier to implement than the processes of the prior art because it provides the residual water content in the whole product by measuring water vapor present in the atmosphere of the freeze-drying device.

The process of the invention hence takes the whole product into account without extrapolating the water content from measures conducted on a few samples (e.g. vials) of the product.

Furthermore, because of its unique characteristics, the process of the invention allows a better monitoring and control of the freeze-drying process which leads to a safer freeze-drying process with less losses in the product which occurred with the processes of the prior art, for example because the freeze-drying was stopped too early and the residual water content was too high.

DETAILED DESCRIPTION OF THE INVENTION

Figure 1:
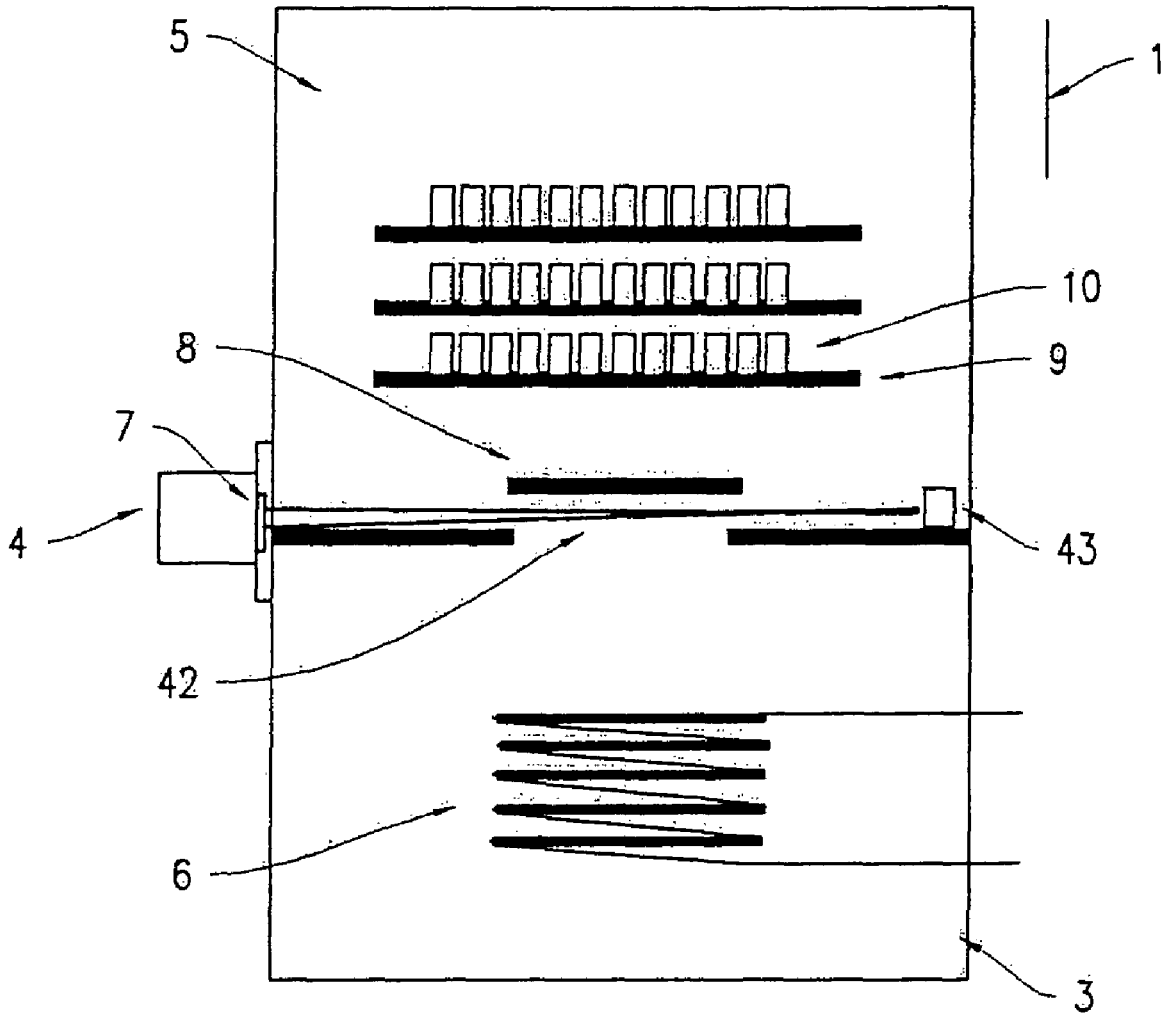
FIG. 1 is a cross-sectional view of a freeze drying apparatus according to a particular embodiment of the invention.

The term "isolated" in the expression "an optical spectrometer isolated from the sterilizable freeze-drying device" means that the optical spectrometer is not in direct contact with the internal volume defined by the freeze-drying device. The apparatus described in this invention relies on a contact free detection method. In other words, the optical spectrometer is not in direct contact with the internal volume of the freeze-drying device and the apparatus of the invention can therefore be easily cleaned and sterilized and is in conformity with the compulsory regulations for pharmaceutical production. The optical spectrometer can be located inside or outside the freeze-drying device. In the case the optical spectrometer is located inside the freeze-drying device it is separated from it by a sterilizable wall so that the optical spectrometer does not contaminate the freeze-drying device. In that case, the wall comprises an aperture or a window which is transparent to the radiation emitted by the optical spectrometer. In the case the optical spectrometer is located outside the freeze-drying device the light radiation is emitted in the atmosphere of the freeze-drying device either through a window transparent for the light radiation, said window being located in a wall of the freeze-drying device or through optical fibers located inside the freeze-drying device.

The term "continuously" denotes short time periods with regard to the total duration of the freeze-drying process, for example one to sixty seconds or one, two, three, four or five minutes.

The expression "an optical spectrometer measures the water vapor present in the atmosphere of the freeze-drying device" means that the optical spectrometer measures either the concentration or the gradient or the sublimation rate at least at one point inside the freeze dying device, and/or the gradient of the water vapor between at least two points in the freeze-drying device.

Sublimation rate denotes the mass flow rate (kg/s) of sublimated or desorbed molecules transferred from the product to the condenser.

The expression "a sterilizable freeze-drying device" denotes a freeze-drying device known in the art which can be sterilized, for example by heating at a particular temperature, and which can stay sterile during the freeze-drying process.

The expression "outside the freeze-drying device" or "inside the freeze-drying device" denotes outside or inside the internal volume defined by the walls of the freeze-drying device".

The expression "transparent for the light radiation" denotes that the windows yield a sufficient optical transmission at the used wavelength.

The expressions "water vapor" and "water vapor determination" denotes, in the context of this application, measuring the number of water vapor molecules per unit volume - according to fundamental gas laws. This unity can be easily converted to the water vapor partial pressure, the molar-, volume- or mass concentration (mass per unit volume) and the volume or mass fraction or any other quantitative measure for the gas humidity content. The partial pressure can be also converted into the correspondent frost point temperature. These values can be correlated to the residual water content of the product to be freeze-dried. The partial pressure of water vapor, measured at any location within the freeze-drying device can be correlated to the moisture content in the product in a test measurement as described in the article "Moisture measurement: a new method for monitoring freeze-drying cycles" by Bardat et al. in J. Parenteral Science & Technology Vol. 47 No. 6 (1993). Measuring the water vapor concentration with the invention described herein thus allows to indirectly monitoring the water content of the product. The determination of the water vapor concentration at any location between the product and the condenser is a measure for the sublimation rate: the smaller the water vapor concentration the smaller is the sublimation rate. The mass transfer through sublimation from the product to the condenser is determined by the partial pressures of water vapor at the sublimation front (within the product) and at the condenser $P_C$. It is also a function of the total pressure in the freeze drying device $P_T$. The sublimation rate dm/dt can also be expressed by the water vapor partial pressure measured at any location between the product and the condenser $P_{sensor}$ by $$\frac{dm}{dt} = \beta * p_T * \log\left(\frac{p_T - p_C}{p_T - p_{Sensor}}\right)$$

with a proportionality constant β. This concept has been described in the article "A new method for on-line determination of residual water content and sublimation end-point during freeze-drying" by N. Genin et al. in Chem. Eng. Processing 35:255-263 (1996). It can be seen in the above equation that for water vapor partial pressures approaching the total pressure, the sublimation rate increases drastically. Monitoring the sublimation rate via water vapor partial pressure measurements thus requires very stable and well calibrated sensors as proposed in this invention. More information on the mass transfer can be drawn from a direct measurement of the water vapor difference between two or more locations in between the product and the condenser. As it will be described hereinafter, in one preferred embodiment the water vapor concentration is measured at two ore more locations in between the vacuum chamber and the condenser. The difference in concentrations or the spatial gradient is also a measure for the sublimation rate. In regions where water vapor is transported both by convective and diffusive flow the sublimation rate dm/dt is proportional to the local gradient of the gas humidity concentration dc/dz divided by one minus the mole fraction of water vapor at this location $x_{wv}$:

$$\frac{dm}{dt} = \beta * \frac{dc/dz}{1 - x_{wv}}$$

If the convective flow can be neglected the sublimation rate is directly proportional to the gradient of the humidity. Otherwise the mole fraction can be determined by the measured water vapor partial pressure divided by the total pressure, simultaneously measured with a manometer.

The sublimation flux can be also determined by simultaneous determination of both the water vapor concentration and the velocity of the water vapor molecules. The product of these two quantities is directly proportional to the sublimation rate as well. It has been shown by M. G. Allen that the flow of a gaseous species can be determined by simultaneous measurements of the concentration and the velocity of the species by means of tunable diode laser spectroscopy in his publication "Diode laser absorption sensors for gas-dynamic and combustion flows" in Meas. Sci. Technol., 9:545-562 (1998). This is based upon the fact, that the amplitude of the absorption line is proportional to the absorbing species concentration whereas the position of the absorption line profile shifts with the velocity of the absorbing molecules due to the Doppler Effect.

The term "reflector" denotes a mirror configuration consisting of one ore multiple mirrors reflecting the light beam from the light source to the optical detector. A single reflector arrangement can e.g. be realized by use of one plane or spherical mirror, reflecting the beam under a defined angle or by a retro-reflector arrangement consisting of two plane mirrors, mounted at an angle of 90 degree relative to each other and reflecting the beam in parallel to the incoming beam. A multi-reflection arrangement can be realized by at least two plane or spherical mirrors.

The term "window" denotes a window which is transparent to the light radiation emitted by the optical emitter. The window is preferably mounted under a small angle relative to the wall (e.g. 10°) so that the light beam passes the window under an angle other than 90° in order to avoid back-reflections into the light path. The window is preferably a wedged window with non-parallel edges in order to avoid reflections between the two edges of the window. These wavelength depended back-reflections have to be avoided as they cause a spectral background (so called "Etalons") and may limit the sensitivity of the optical spectrometer. When the light radiation is in the visible or near infrared spectral range, several kinds of glasses e.g. fused silica can be used. Such windows can for example be obtained at the BASF GmbH, Germany.

The term "optical emitter" denotes a laser light source, preferably a tunable diode laser. The diode lasers most commonly used in laser absorption spectrometers are distributed feedback (DFB) diode lasers as they yield a very good frequency stability (e.g. supplied by Laser Components GmbH). Other lasers sources may be e.g. quantum cascade lasers or lead-salt diode lasers. Laser radiation is tuned over one or multiple isolated water vapor absorption lines by tuning the injection current, the temperature of the laser chip or the geometry of an external cavity resonator in modulated or pulsed operation.

The term "optical detector" denotes a detector, detecting the light intensity of the optical emitter after the attenuation by the absorbing molecules to be detected (if any present). Optical detectors are commonly photo diodes as e.g. supplied by Hamamatsu.

As already stated above, in one aspect, the invention relates to an apparatus (1) for the monitoring and the control of water vapor (2) in a freeze-drying process comprising a sterilizable freeze-drying device (3) and an optical spectrometer (4) isolated from the internal volume of the sterilizable freeze-drying device (3), said optical spectrometer (4) measuring the water vapor (2) present in the atmosphere of the freeze-drying device (3) without adversely affecting the sterilizability of the freeze-drying device.

The freeze-drying device (3) can be selected from freeze-devices known in the art and can be suitably adapted to the apparatus of the invention (1) so as to be equipped with an optical spectrometer (4). Examples of suitable freeze-drying device are those that are commercially available and known in the art, e.g. from one of the following companies Hof, Edwards or Steris.

In a particular embodiment of the apparatus (1) of the invention, the optical spectrometer (4) is isolated from the internal volume of the sterilizable freeze-drying device by a window (7).

In a particular embodiment of the apparatus (1) of the invention, the optical spectrometer (4) comprises an optical emitter (40) and an optical detector (41) located outside the freeze drying device (3), said optical emitter (40) being separated from the internal volume of the freeze drying device (3) by a first window (7) located in a wall of said freeze drying device (3), and said optical detector (41) being separated from the internal volume of the freeze drying device (3) by a second window (7') located in a wall of said freeze drying device (3).

In a particular embodiment of the apparatus (1) of the invention, the optical spectrometer (4) measures the water vapor (2) present in the atmosphere of the freeze-drying device (3) by emitting a light radiation in the atmosphere of the freeze-drying device (3) through a window (7) located in a wall of the freeze-drying device (3). In this case, the optical spectrometer (4) can comprise an optical emitter (40) and an optical detector (41) and the light radiation (42) emitted by the optical emitter (40) in the atmosphere of the freeze-drying device (3) through the window (7) is reflected in direction of the optical detector (41) by at least one reflector located inside the freeze-drying device (3) and at a defined distance from the optical spectrometer (4).

In another embodiment of the apparatus (1) of the invention, the optical spectrometer (4) measures the water vapor (2) present in the atmosphere of the freeze-drying device (3) by emitting a light radiation in the atmosphere of the freeze-drying device (3) through optical fibers (6) located inside the freeze-drying device (3).

In any one of the embodiments according to the invention described herein the optical spectrometer (4) measures:

the concentration of the water vapor (2) in the freeze-drying device (3); or/and the gradient of the water vapor (2) between two or more points in the freeze-drying device (3); or/and the sublimation rate of the water vapor (2) at a defined point in the freeze-drying device (3).

In any one of the embodiments according to the invention described herein the optical spectrometer (4) can be a laser absorption spectrometer, which emits in the infrared or in the visible spectral range. Still preferably, the laser spectrometer (4) emits between about 1 μm and about 15 μm.

In a preferred embodiment the monitoring system is a tunable diode laser spectrometer. The application of such a system for the sensitive detection of gas phase humidity has been described in "High precision trace humidity measurements with a fibre-coupled diode laser absorption spectrometer at atmospheric pressure" by B. Schirmer et al. in Meas. Sci. Technol., 11:382-391 (2000). A detection limit of 1 μbar has been demonstrated for water vapor. The sensitivity of this method is thus sufficient for the application in freeze-drying. It has been furthermore been reported that this technique is well suited for the determination of mass transfer coefficients and the characterization of evaporation rates (see. B. Schirmer et al.: "A new method for the determination of membrane permeability by spatially resolved concentration measurements." *Meas. Sci. Technol.* 15: 195-202 (2004) and B. Schirmer et al.: "Experimental investigation of the water vapour concentration near phase boundaries with evaporation." *Meas. Sci. Technol.* 15: 1671-1682 (2004)).

In any one of the embodiments according to the invention described herein, the optical spectrometer (4) can measure the absorption of the radiation due to water vapor molecules either at a fixed or a various wavelengths.

In any one of the embodiments according to the invention described herein, the temperature of the absorbing molecules is derived from the absorption line profile, detected by the optical spectrometer (4), as the line width is proportional to the square root of the temperature.

In any one of the embodiments according to the invention described herein, the freeze-drying device (3) can further comprise a chamber (5) and a condenser (6) which can be separated by a valve (8) and an optical spectrometer (4) which measures the water vapor (2) present in the atmosphere at any location within the freeze drying device, for example in the atmosphere passing the valve (8) from the chamber (5) to the condenser (6).

In any one of the embodiments according to the invention described herein, the optical spectrometer (4) can measure the water vapor (2) present in the atmosphere inside the freeze-drying device (3) either continuously or at defined time intervals.

In a particular embodiment, the apparatus (1) of the invention further comprises a computer with software able to analyze the measures returned by the optical spectrometer (4) and to convert the measures into the water vapor (2) present in the freeze-drying device (3).

In any one of the embodiments described hereinabove, it is possible to measure either continuously or at defined intervals the water vapor (2) present in the atmosphere of the internal volume of the freeze-drying device (3), for example, of the atmosphere passing the valve (8) from the chamber (5) to the condenser (6).

As already described hereinabove, light is coupled into the freeze-drying apparatus either through a window (7) or through optical fibers penetrating the apparatus.

The invention also relates to a method for the monitoring and the control of the water vapor (2) in a freeze-drying process which can be conducted under sterile conditions comprising the steps of:

a) freeze-drying a material intended to be freeze-dried in an apparatus (1) of the invention; and b) measuring the water vapor (2) present in the atmosphere of the freeze-drying device (3) with an optical spectrometer (4).

The method of the invention can further comprise the step of:

c) analyzing the measures returned by the optical spectrometer (4) in step (b) optionally with a computer.

The method of the invention can also comprise the step of:

d) determining and effecting the end of either the primary or the secondary drying phase of the freeze-drying process according to the analyze performed in step (c).

The method of the invention can further comprise the step of:

e) regulating the freeze-drying process according to the analyze performed in step (c).

In the method of the invention, the measure of the water vapor (2) in step (b) can be performed continuously or at defined intervals.

The invention also relates to the use of an optical spectrometer for:

monitoring of the water vapor;

measuring the water vapor;

developing a freeze drying cycle (For example: The signal (e.g. dew point, water vapor concentration, water vapor mass concentration, water vapor partial pressure, water vapor concentration gradients, water vapor flow velocities, water mass transfer . . . ) changing with shelf temperature/total pressure, allowing to conveniently find the process boundaries (for e.g. pressure, temperature and product temperature) representing a secure process execution at a minimal time and energy effort.

controlling a freeze-drying process;

the evaluation of the progress of a freeze-drying process; (For example: Any calculation (e.g. slope, $1^{st}/2^{nd}$ derivative . . . ) of the dew point or derived variables (e.g. water vapor concentration, mass concentration, water vapor partial pressure, water vapor concentration gradients, water vapor flow velocities, water vapor mass transfer . . . ) changing over time, that support the decision to change from primary drying conditions to secondary drying conditions or to end the drying process either by the machine itself or the staff observing the process.

the calculation of the sublimation rate in a freeze-drying process;

the determination of the end of either the primary or secondary drying phase in a freeze-drying process; (For example: The signal (e.g. dew point, water vapor concentration, water vapor mass concentration, water vapor partial pressure, water vapor concentration gradients, water vapor flow velocities, water vapor mass transfer . . . ) reaching a certain threshold value representing a state of the drying process that allows to change from primary to secondary drying conditions either by the machine itself or the staff observing the process or the signal (e.g. dew point, water vapor concentration, water vapor mass concentration, water vapor partial pressure, water vapor concentration gradients, water vapor flow velocities, water vapor mass transfer . . . ) reaching a certain threshold value representing a state of drying process that allows to end the drying process either by the machine itself or the staff observing the process the detection of malfunction of the freeze-drying device (3) in a freeze-drying process; (For example: The signal (e.g. dew point, water vapor concentration, water vapor mass concentration, water vapor partial pressure, water vapor concentration gradients, water vapor flow velocities, water vapor mass transfer . . . ) reaching a certain threshold value that might harm the product, initiating risk mitigation action (e.g. fast refreezing, fast evacuation . . .) either by the machine itself or the staff observing the process.

wherein the optical spectrometer (4) measures the water vapor (2) present in the atmosphere of a freeze-drying device (3).

Referring to FIG. 1, the apparatus (1) of the invention comprises an optical spectrometer (4), a freeze-drying device (3) and an optical spectrometer (4). The freeze-drying-device can comprise a freeze-drying chamber (5) which can be equipped with shelves (9) for supporting the product (10), e.g. vials containing the product intended to be freeze-dried. The freeze-drying device (3) can further comprise a condenser (6) which is separated from the chamber (5) by a valve (8).

In the embodiment shown on FIG. 1, the optical spectrometer (4) measures the water vapor (2) passing the valve (8) by emitting a light radiation into the atmosphere of the freeze-drying device (3) through a window (7), said window (7) being located in a wall of the freeze-drying device (3) separating the atmosphere inside the freeze drying device from the atmosphere inside the spectrometer. Te Window can also be part of or being located inside the spectrometer.

In this embodiment, the optical spectrometer (4) comprises an optical emitter (40) and an optical detector (41) and the light radiation (42) emitted by the optical emitter (40) in the atmosphere of the freeze-drying device (3) through the window (7) is reflected in direction of the optical detector (41) by at least one reflector (43) located inside the freeze-drying device (3) and at a defined distance from the optical spectrometer (4). The light radiation (42) reflected by the reflector (43) is detected by an optical detector (41). In the embodiment shown on FIG. 1, the optical emitter (40) and the optical detector (41) are located in a housing on the same side, at the opposite side of the reflector (43).

Figure 2A:
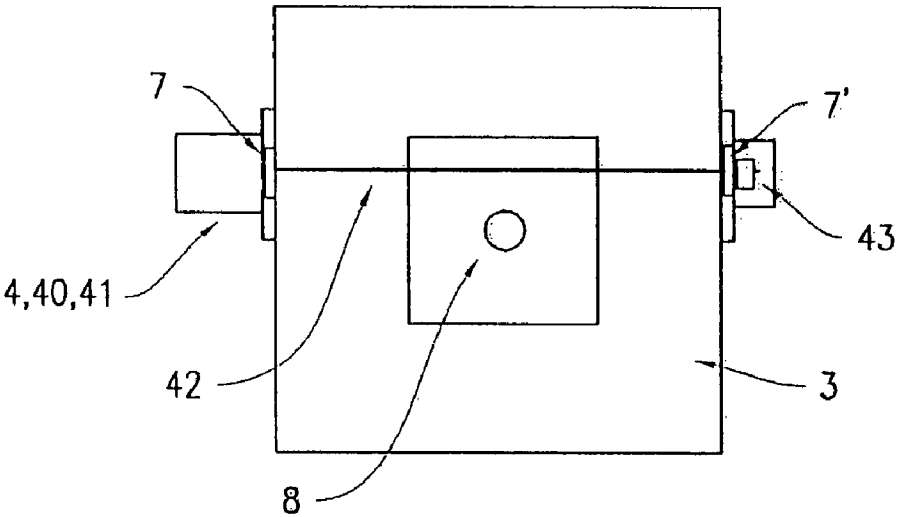
FIGS. 2A, 2B, 2C, 2D and 2E show top-sectional views of a freeze drying apparatus according to four different embodiments of the invention.

It is to be understood that the optical spectrometer (4) with the optical emitter (40), optical detector (41) and reflector (43) can be organized or placed differently. For example, referring to FIG. 2A, the reflector (43) can be located outside the freeze-drying device (3), separated from the internal volume of the freeze-drying device by a second window (7'). In this embodiment, the light radiation (42) emitted by the optical emitter (40) passes through the first window (7), crosses the internal volume defined by the walls of the freeze-drying device (3), passes through the second window (7'), is reflected by the reflector (43), passes again through the window (7'), crosses again said internal volume and passes again through the window (7) before being detected by the optical detector (41).

Figure 2B:
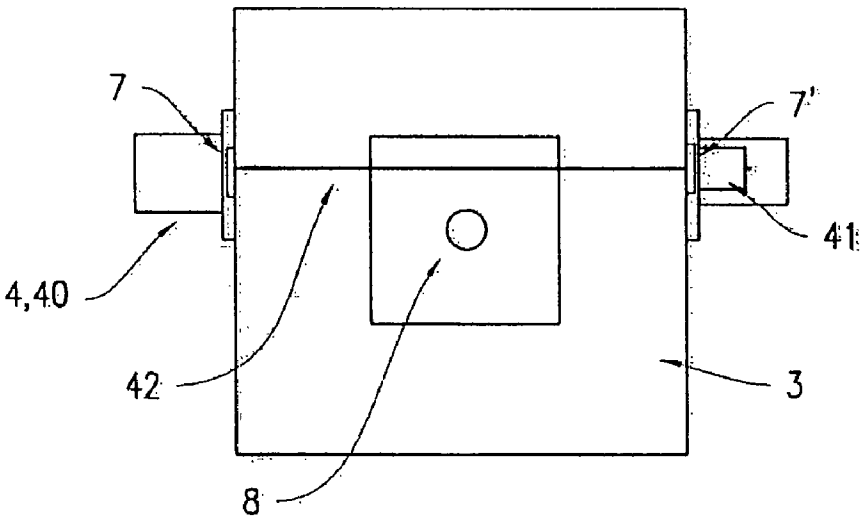

FIG. 2B shows another possible configuration, wherein the optical emitter (40) and the optical detector (41) are located oppositely toward each others against the freeze-drying device and outside the freeze-drying device (3). They are separated from said volume by two windows (7) and (7') located in the wall of the freeze-drying device (3). In this embodiment, the light radiation (42) emitted by the optical emitter (41) passes the first window (7), crosses the internal volume of the freeze-drying device (3), passes the second window (7') and reaches the optical detector (41). The embodiments of FIG. 2B offers the advantage that it does not require a reflector (43) to be placed in the internal volume of the freeze-drying device (3), but requires two windows (7) and (7').

Figure 2C:
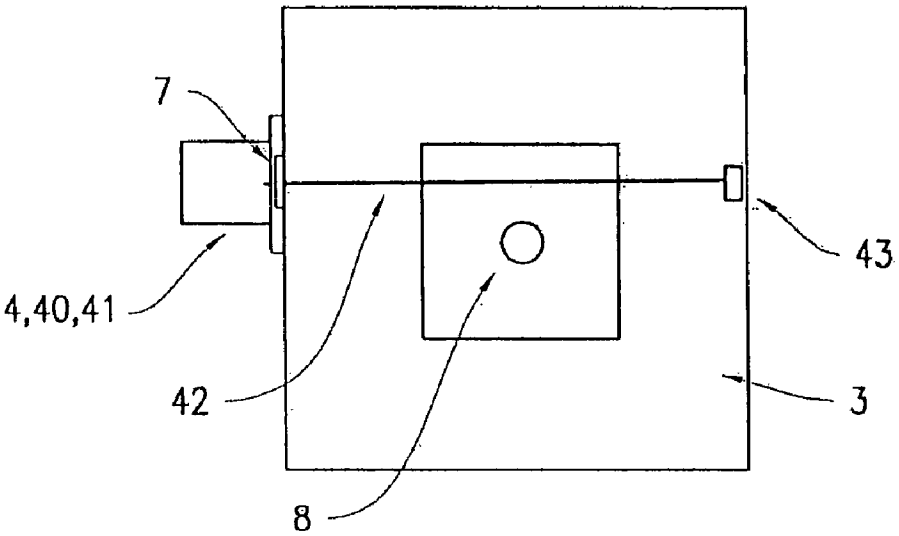

FIG. 2C is a top-sectional view of the embodiment already shown on FIG. 1, wherein the reflector (43) is located inside the freeze-drying device (3).

Figure 2D:
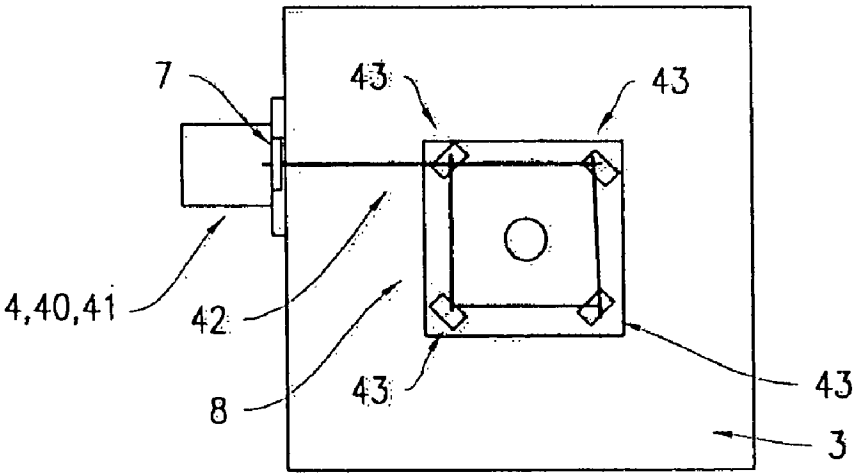

FIG. 2D shows yet another possible configuration for the optical spectrometer (4) and reflector (43) in the apparatus (1) of the invention. In this embodiment, the optical spectrometer (4) comprising an optical emitter (40) and an optical detector (41) are situated in a housing fixed outside the freeze-drying device (3), on a side wall of said freeze-drying device (3), separated from the internal volume of the freeze-drying device (3) by a window (7). Several reflectors (43), e.g. 4, as shown on drawing D of FIG. 3 can be placed at a certain distance from each others inside the freeze-drying device (3) so as to allow a path of light radiation in a part of the internal volume of the freeze-drying device (3) from the optical emitter (40) to the optical detector (41). The geometry of the path of the light radiation show on FIG. 2D is a square, but it is to be understood that all geometries are possible, provided that the number of reflectors (43) and their placement in the volume are made adequately. The advantage of this embodiment is that the path of the light radiation (42) covers more of the internal volume of the freeze-drying device (3) with respect to the others embodiments described herein. Since more of said internal volume is covered, the measure is more representative of the internal volume. The fraction of the absorbed power can be increased by an increased optical path length between the light radiation source and the detector achieved by multiple reflections between two or more reflectors before the radiation reaches the detector. Multi-reflection arrangements have been described in the articles "Long optical paths of large aperture" by J. U. White in J. Opt. Soc. Am., 32: 285-288 (1942) and "Very long optical paths in air" by J. U. White in J. Opt. Soc. Am., 66 (5):411-416 (1976). An alternative multiple reflection arrangement has been described in "Off-axis paths in spherical reflector interferometers" by D.

Herriot et al. in Appl. Opt., 3 (4):523-526 (1964), "Folded optical delay lines" by D. Herriot et al. in Appl. Opt., 4 (8):883-889 (1964) and "Astigmatic reflector multipass absorption cells for long-path-length spectroscopy" by J. B. McManus et al. in Appl. Opt., 34 (18): 3336-3348 (1995).

Figure 2E:
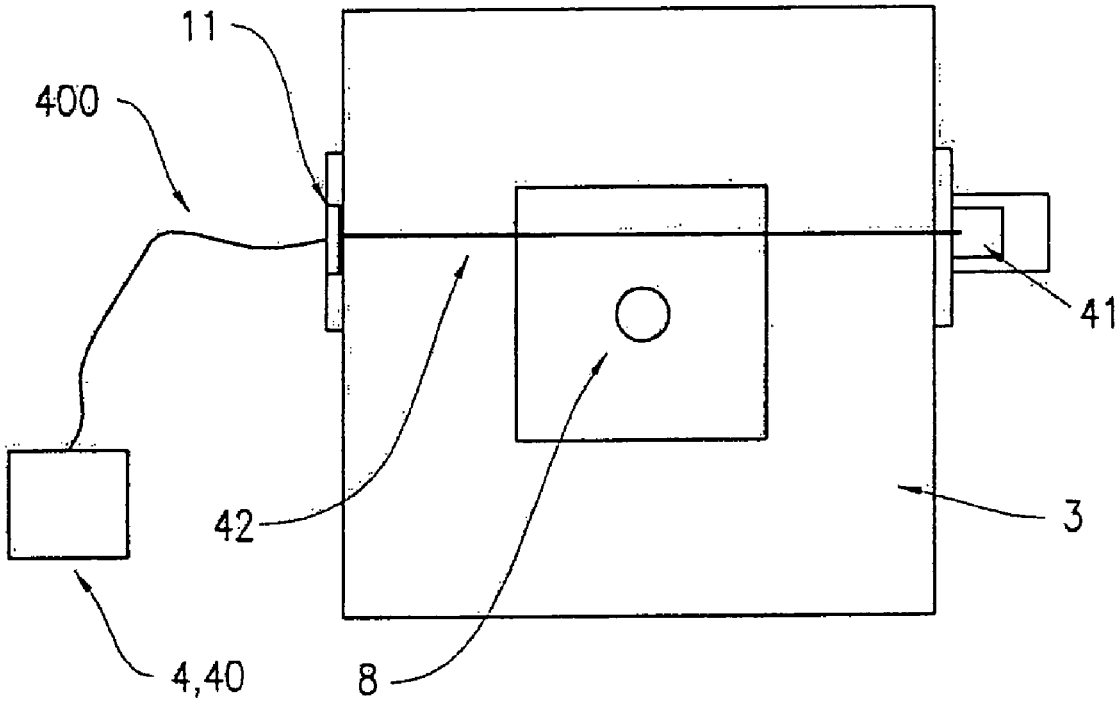

FIG. 2E shows still another possible configuration, wherein the optical emitter (40) comprises an optical fiber (400) which drives the radiation light (43) into the internal volume of the freeze-drying device (3) through an aperture (11) in a wall of said freeze-drying device (3). The optical detector (41) is fixed against a wall of the freeze-drying device (3), outside the freeze-drying device at the opposite side of the optical fiber (400) and is separated from the internal volume of the freeze-drying device (3) by a window (7) so as to catch the light radiation (42) after its path through the internal volume of the freeze-drying device (3). This embodiment requires only one window (7).

Figure 3:
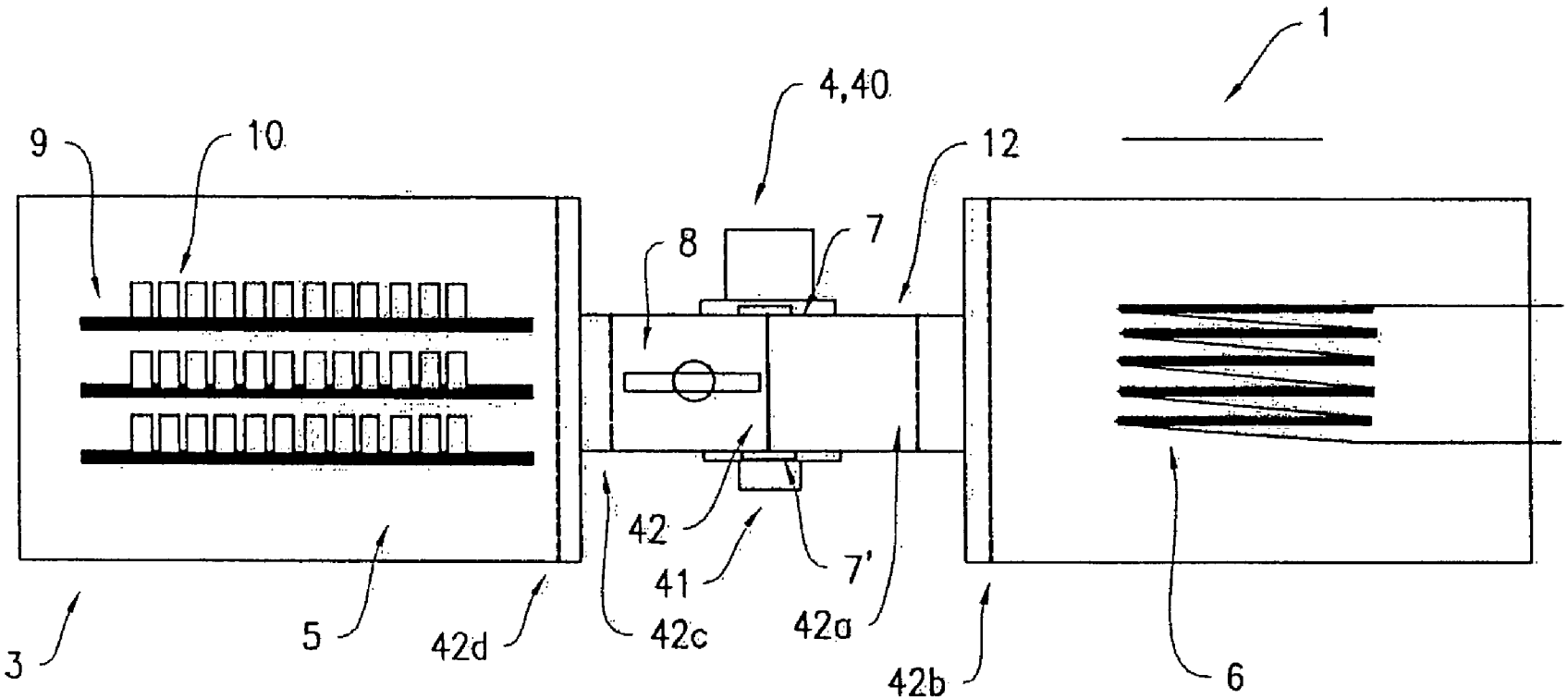
FIGS. 3 and 4 are cross-sectional views of a freeze drying apparatus according to particular embodiments of the invention.

FIG. 3 shows an alternative configuration of the apparatus (1). The chamber (5) of the freeze-drying device (3) is connected to the condenser (6) by a duct. The valve (8), allowing separating the chamber (5) from the condenser (6) is located inside said duct. The valve (8) allows to interrupt the flow of the water vapor (2) sublimated from the product (10) to the condenser (6). The optical spectrometer (4), containing the optical emitter (40) is attached to the duct. The light radiation (42) enters the atmosphere of the apparatus (1) through an optical window (7) and exits the duct at the opposite end through a second window (7'). The light radiation is detected by the optical detector (41). It is well understood that in analogy to FIGS. 2A, 2B, 2C, 2D and 2E, the light can alternatively reflected back to the spectrometer (4) containing both the optical emitter (41) and optical detector (42) with a reflector (43) located inside or outside the duct; a multi-reflection arrangement is also feasible as well as connecting the optical spectrometer (4) to the apparatus (1) by optical fibers (400). The optical spectrometer (4) can be mounted at any location of the duct or close to the duct at the chamber (5) or the condenser. The alternative locations of the light beam (42), (42*a*), (42*b*), (42*c*), (42*d*) are also denoted in FIG. 2E.

In an embodiment as shown on FIG. 3, the apparatus of the invention comprises an optical spectrometer (4) comprising an optical emitter (40) and an optical detector (41) located at the opposite side of a freeze-drying device (3) comprising a freeze-drying chamber (5) and a condenser (6) which can be separated from the freeze-drying chamber (5) by a valve (8), and wherein, the optical emitter (40) and the optical detector (41) are located outside the freeze drying device (3), said optical emitter (40) being separated from the internal volume of the freeze drying device (2) by a first window (7) located in a wall of said freeze drying device (3), and said optical detector (41) being separated from the internal volume of the freeze drying device (3) by a second window (7') located in a wall of said freeze drying device (3) opposite to the optical emitter (40).

Figure 4:
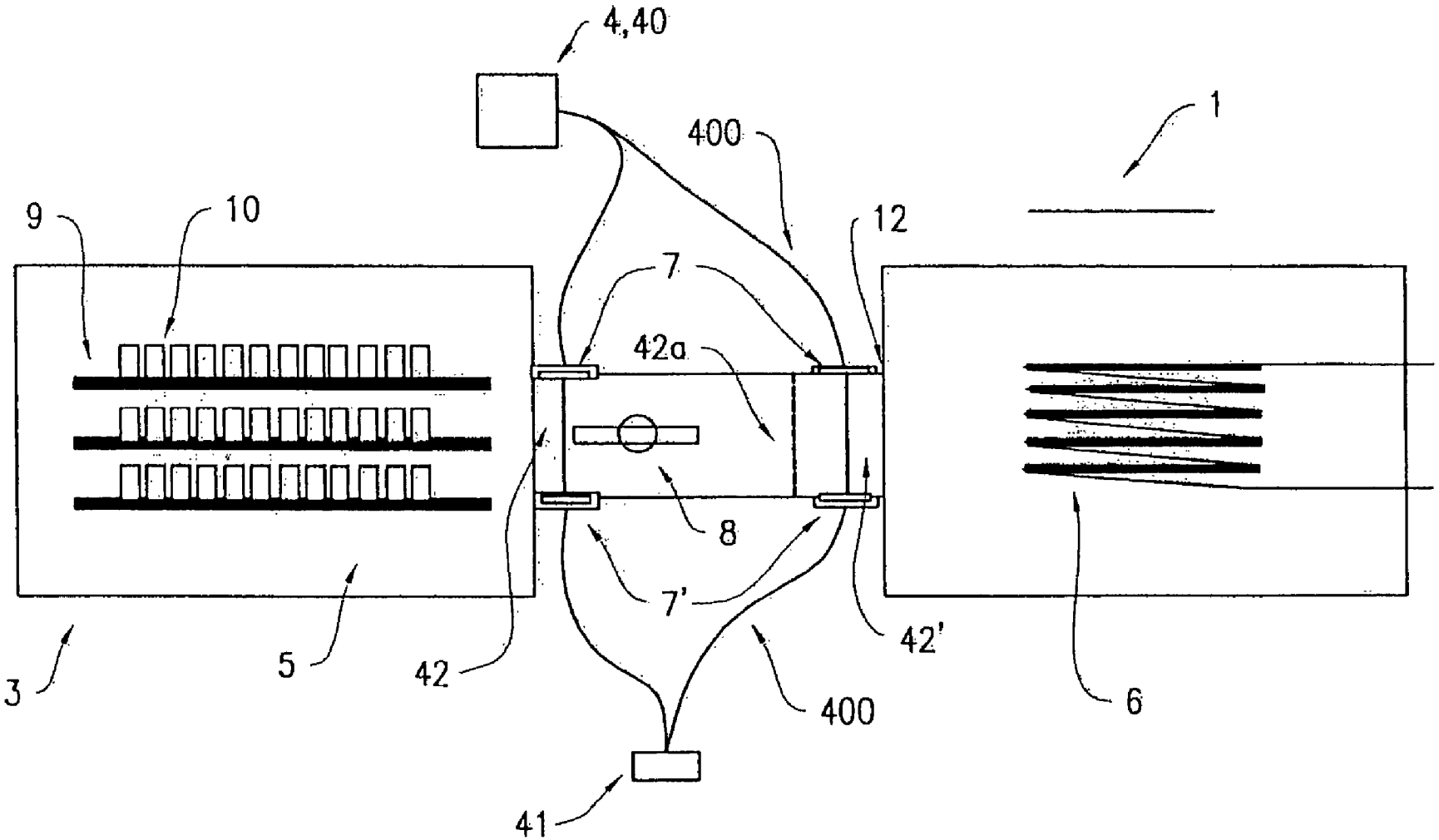

FIG. 4 shows a similar configuration of the apparatus (1) as in FIG. 3. In contrast to FIG. 2E, at least two light beams (42) and (42') of the optical spectrometer (4) radiate through the atmosphere of the apparatus (1) in order to measure the water vapor partial pressure at least two different locations. It is well understood that the two or more beams may be located at different locations of the apparatus in analogy to FIG. 2E. The distance of the two or more beams (42*a*) to each other can vary as well. The beams of the spectrometer (4) are brought to the freeze-drying device (3) by means of optical fibres (400) radiating through optical windows (7). The beams exiting the freeze-drying device (3) through a second set of windows (7') are coupled into optical fibers (400) as well and are detected by means of an optical detector (41). Alternatively, the beams could be detected by two or more optical detectors (41), flanged to the apparatus. The multiple beam configuration could also be realized by multiple optical spectrometers (4) attached to the apparatus or in any of the optical configurations proposed in FIGS. 2A, 2B, 2C, 2D and 2E.

This configuration allows detecting the difference of the water vapor partial pressure at different locations and thus the concentration gradient in order to derive the sublimation rate.

In an embodiment as shown on FIG. 4, the apparatus of the invention comprises an optical spectrometer (4) comprising an optical emitter (40) and an optical detector (41), a freeze-drying device (3) comprising a freeze-drying chamber (5) and a condenser (6) which is separated from the freeze-drying chamber (5) by a duct (12) which can be closed by a valve (8), and wherein, the optical emitter (40) and the optical detector (41) are located outside the duct (12), said optical emitter (40) being separated from the internal volume of the duct (12) by a first window (7) located in a wall of said duct (12), and said optical detector (41) being separated from the internal volume of the duct (12) by a second window (7') located in a wall of said duct (12) opposite to the optical emitter (40).

In this embodiment, the apparatus can further comprise at least one reflector (43) located inside the duct (12) at a defined distance from the optical emitter (40) and from the detector (41) so as to reflected a light radiation (42) emitted by the optical emitter (40) toward the optical detector (41).

EXAMPLE 1

To test the functionality of the embodiment of FIG. 1 of the apparatus according to the invention, a test run was performed, by lyophilizing samples of a pharmaceutical product. The condenser temperature and the dew point temperature were recalculated to be represented as water vapor partial pressures. Additionally the total pressure reported by the pressure gauge of the lyophilizer was reported in the graphic of FIG. 5

Figure 5:
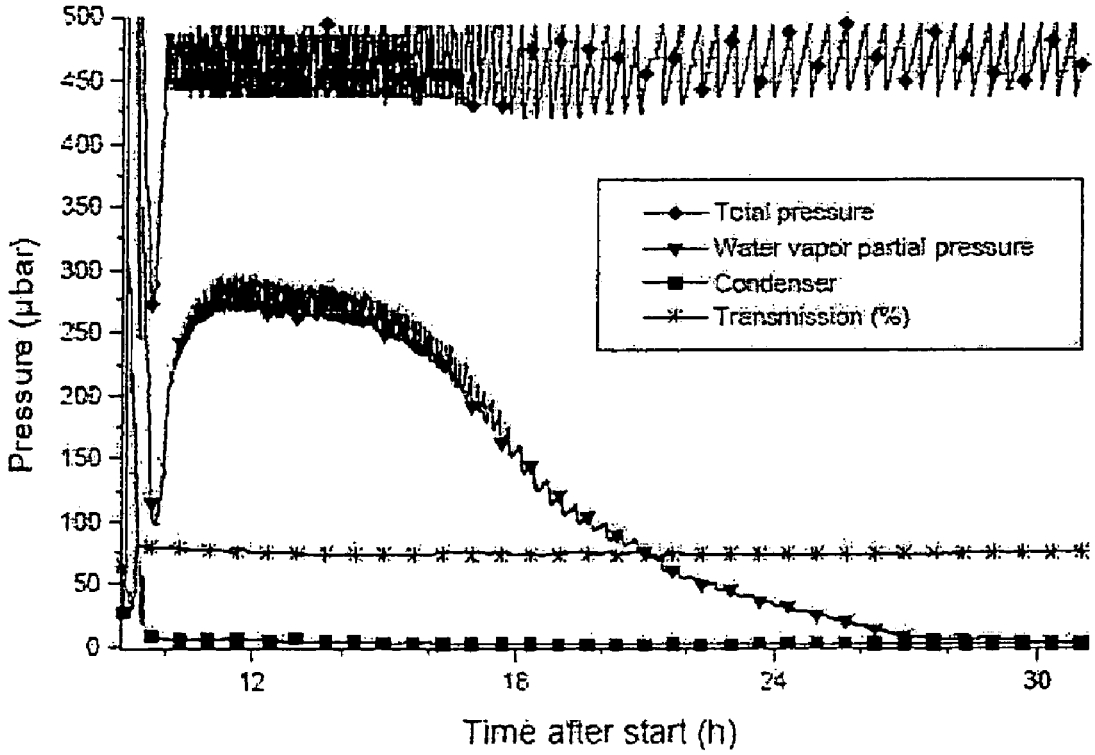
FIG. 5 is a diagram showing the data collected during a test run performed by lyophilizing samples of a pharmaceutical product using apparatus setup as illustrated in FIG. 1.

Referring to FIG. 5, the total pressure in the lyophilizer was kept constant at approx. 450-500 μbar during the time of the experiment (it only showed a small variance due to the characteristic of the pressure regulating system). Also the water vapor partial pressure representing the condenser temperature (at a very low level), showed only minor variability. The results of the experiment clearly showed that (as expected) the water vapor partial pressure of the process gas (calculated from the dewpoint temperature reported by the laser spectrometer) appeared to be between the total pressure in the lyophilizer and the water vapor partial pressure at the condenser surface. During the sublimation phase, there was a steady and relatively high amount of water vapor (250-300 μbar) in the process gas. During this phase the water vapor partial pressure was contributing approx. 60% of the total pressure in the lyophilizer. During the experiment the water vapor partial pressure was contributing decreasing amounts to the total pressure. The end of the drying process was reached at the point in time when the water vapor partial pressure showed values that were close to or equal to the water vapor pressure representing the condenser temperature (near 0 μbar).

EXAMPLE 2

Two lyophilization cycles were performed to test the apparatus according to the invention as depicted in FIG. 1. The purpose of these two specific lyophilization cycles was to illustrate but not limit the invention to the specific setups used. The lyophilization cycles were typical for said product. It is pointed out that other combinations of shelf temperature, total pressure, and condenser temperature are within the competences of the person skilled in the art.

The experimental setup corresponded to a routine utilization of the apparatus of the invention in a productive lyophilization environment.

Each of the two lyophilization cycles were performed with two samples (sample 1 and sample 2). Samples 1 and 2 were samples of the same pharmaceutical product.

Figure 6:
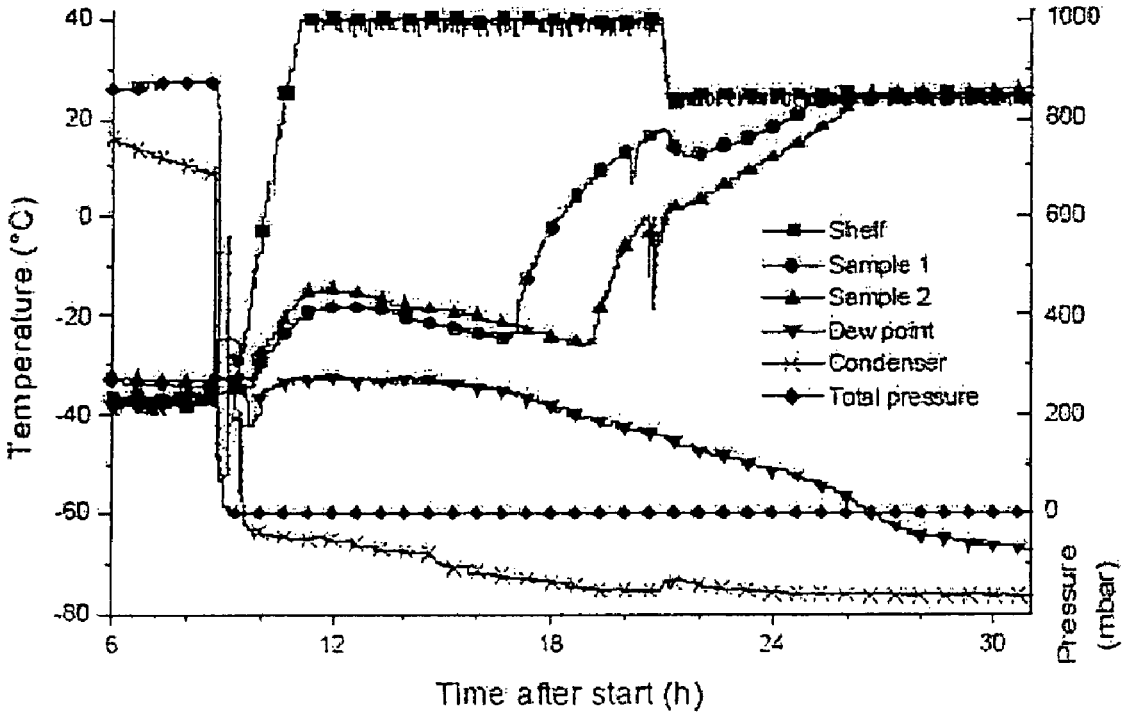
FIGS. 6 and 7 are diagrams showing original process data elaborated using an apparatus setup as illustrated in FIG. 1 and corresponding parts of the description.
Figure 7:
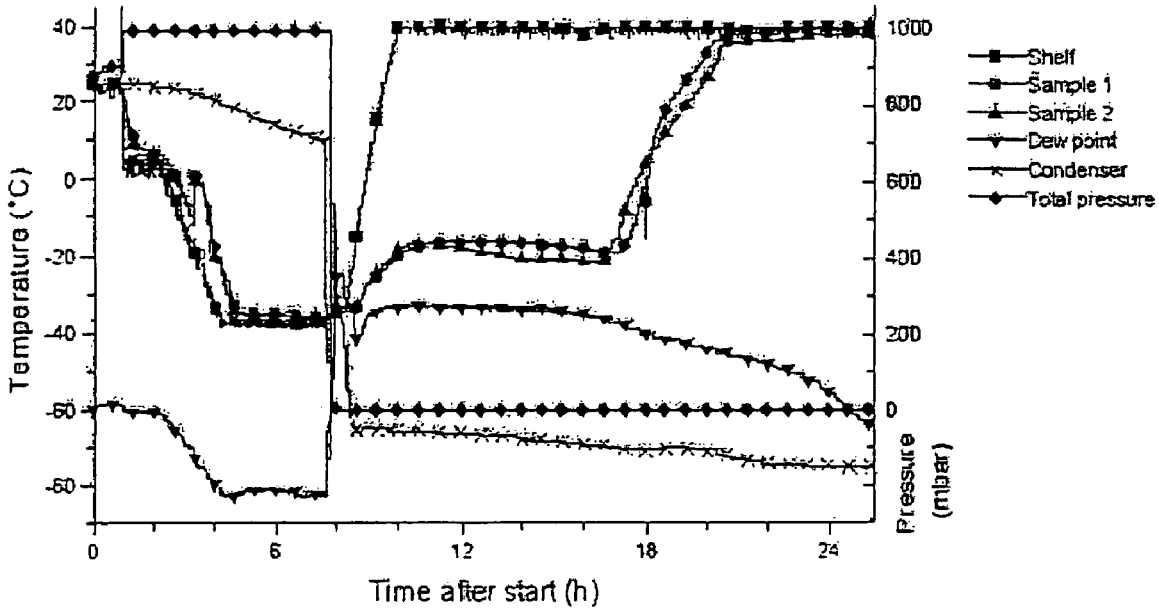

The data collected during the first lyophilization cycle with samples 1 and 2 was reported in FIG. 6, while the data collected during the second lyophilisation cycle with samples 1 and 2 was reported in FIG. 7.

Figure 8:
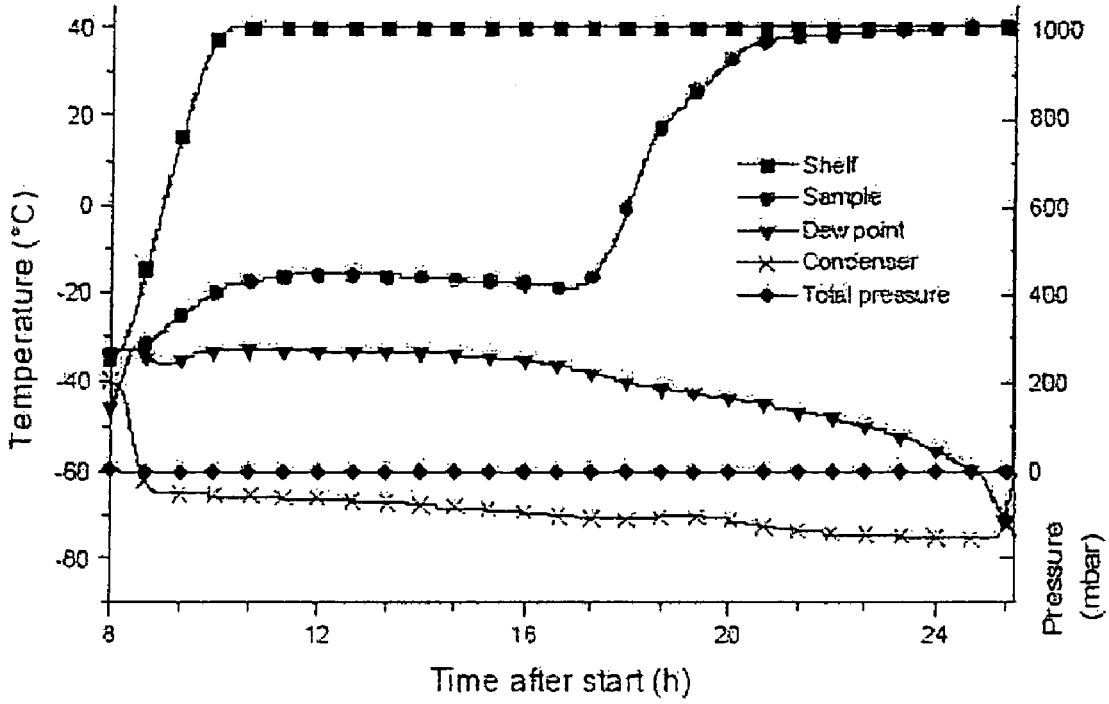
FIG. 8 is a schematic, simplified diagram of the process data of FIGS. 5 and 6.

FIG. 8 is a simplified diagram based on FIG. 7 which can be used for the following explanations and interpretations of the process according to the invention as depicted on FIG. 7.

In FIGS. 6, 7 and 8, the curves identified with:

a square symbol represents the shelf temperature, a circle symbol represents the temperature of product sample 1, a triangle symbol represents the temperature of product sample 2, a reversed triangle symbol represents the dew point temperature, a cross symbol represents the condenser's temperature, a lozenge symbol represents the total pressure.

Referring to FIG. 6, during the first lyophilisation cycle, the primary drying started approx. 8.5 h after the start of the experiment (when the shelf temperature was raised to 40° C.). From that moment on, the values reported by the spectrometer represented correct dew point values.

It could be observed that at the beginning of the primary drying (sublimation phase) the heat applied by the lyophilizer generated a strong and steady flow of water vapor from the vials towards the condenser. Several factors indicated the sublimation of water in the system:

The product temperature was approx. 60 K lower, than the shelf temperature—this was due to the high evaporative heat loss.

The condenser temperature was approx. 10 K higher than it would be in a completely dry system—this was due to the high amount of heat warming the condenser because of condensing water molecules.

The laser absorption spectrometer measured a dew point value that was between the dew point temperature above ice in the condenser and the dew point temperature above ice at the lyophilization front (inside the vials). Explanation: if no water evaporated from the vials, the signal of the probe would be very similar to the condenser temperature because this represents the coldest spot inside the system.

The period of steady and strong sublimation of water molecules lasted until approximately 17-18 h after the start of the run. At that point in time following factors indicated that the majority of the ice in the vials was removed and was trapped on the condenser surface:

The product temperature started converging towards the shelf temperature reaching it after approx. 26 h—the data in test run 1 indicated a significant inhomogeneity of the product temperature (large difference between the 2 sampled vials).

The condenser temperature was significantly lower than reported at the start of the drying process, because less heat was conveyed to the condenser due to smaller amounts of condensing water molecules on the chilled surface.

The slope of the signal of the laser absorption spectrometers changed. Explanation: less water vapor flowed from the vials towards the condenser leading to a smaller water vapor partial pressure (while the total pressure in the system remained constant).

The product temperature probes reached an equilibrium with the shelves approx. 26—after the experiment was started. At that point in time the free water (ice) inside the sampled vials has vanished. The dry lyophilization cake remained in the vial together with water that was bonded to the molecules in the cake. The bonded water was released from the cake by desorption—therefore much slower than the water from the ice that was released by sublimation. The laser absorption spectrometer signal consequently changed its slope again representing the smaller fraction of water vapor contribution to the total pressure measured as constant.

The change in the measuring signal (dew point) represents very well the physical stages the product is undergoing during the drying process:

1. strong and steady sublimation (up to approx. 16 h), during the primary drying phase (ice is sublimating out of the vials and the vapor is moving to the condenser)
2. decreasing dew point values (change in slope) representing the end of the sublimation process (there is nearly no ice (not bonded water) left), and the start of the desorption phase (bonded water is transferred to the condenser slowly).
3. a further change in slope and absolute values reaching nearly the condenser temperature when the desorption (secondary drying) phase ends (24 h). The product reached its final dryness.

Referring to FIG. 7 or 8, the second lyophilization cycle showed a very similar process. The main difference between the two experiments was the missing decrease of the shelf temperature after approx. 20 h. This change resulted in a faster drying of the samples, represented by earlier change in the product temperature (represented as sample 1/2), reaching shelf temperature after 20-22 h instead of after 26 h in experiment 1.

The recorded data of all three experiments clearly indicated that the measurement principle was applicable in the requested field of use. The recorded signal was, as opposed to the product temperature signal, representative for all vials in the lyophilization chamber. As a result, it changed not as rapidly as the product temperature, but the visible slope change indicated clearly the change from the sublimation to the desorption phase. This gave a clear hint, that for the great majority of vials the secondary drying (if necessary) could begin. At the end of the drying process the new signal could be used to support the decision whether the vials could be stoppered or if the vials needed some more time under drying conditions to reach the drying specification. The signal of the probe related to a parameter that was directly correlated to the relevant process factor—water vapor/residual moisture.

What is claimed:

1. An apparatus for the monitoring and the control of water vapor in a freeze-drying process comprising (a) a sterilizable freeze-drying device and (b) an optical spectrometer isolated from the internal volume of the sterilizable freeze-drying device by a window, wherein said optical spectrometer measures the water vapor present in the atmosphere of the freeze-drying device by emitting a light radiation in the atmosphere of the freeze-drying device through the window, said window being located in a wall of the volume defined by the freeze-drying device, wherein the optical spectrometer comprises an optical emitter and an optical detector located outside said freeze drying device, said optical emitter being separated from the internal volume of the freeze drying device by a first window located in a wall of said freeze drying device, and said optical detector being separated from the internal volume of the freeze drying device by a second window located in a wall of said freeze drying device.

2. The apparatus of claim 1, wherein the light radiation emitted by the optical emitter in the atmosphere of the freeze-drying device is reflected in direction of the optical detector by at least one reflector located inside the freeze-drying device and at a defined distance from the optical emitter.

3. An apparatus for the monitoring and the control of water vapor in a freeze drying process which comprises (a) an optical spectrometer comprising an optical emitter and an optical detector and (b) a freeze-drying device comprising a freeze-drying chamber and a condenser which can be separated from the freeze-drying chamber by a valve, and wherein, the optical emitter is outside the freeze-drying device, separated from the internal volume of the freeze-drying device by a window located in a wall of said freeze-drying device, the freeze-drying device further comprising at least one reflector located inside or outside the freeze-drying device at a defined distance from the optical emitter and from the detector so as to reflect a light radiation emitted by the optical emitter toward the optical detector;

wherein the optical emitter and the optical detector of the optical spectrometer are located at the opposite side and outside of said freeze-drying device said optical emitter being separated from the internal volume of the freeze drying device by a first window located in a wall of said freeze drying device, and said optical detector being separated from the internal volume of the freeze drying device by a second window located in a wall of said freeze drying device opposite to the optical emitter.

4. The apparatus of claim 3 wherein a duct which can be closed by a valve separates the freeze drying chamber and the condenser and wherein, the optical emitter and the optical detector are located outside the duct, said optical emitter being separated from the internal volume of the duct by a first window located in a wall of said duct, and said optical detector being separated from the internal volume of the duct by a second window located in a wall of said duct opposite to the optical emitter.

5. The apparatus of claim 4, which further comprises at least one reflector located inside the duct at a defined distance from the optical emitter and from the detector so as to reflect a light radiation emitted by the optical emitter toward the optical detector.

* * * * *